United States Patent [19]

Bendoni et al.

[11] 4,309,100

[45] Jan. 5, 1982

[54] FILM PROCESSOR FOR INSTANT TYPE TRANSPARENCY FILM

[75] Inventors: Leonard V. Bendoni, Framingham; Richard R. Wareham, Marblehead, both of Mass.

[73] Assignee: Polaroid Corporation, Cambridge, Mass.

[21] Appl. No.: 207,686

[22] Filed: Nov. 17, 1980

[51] Int. Cl.[3] ..... G03D 5/06

[52] U.S. Cl. ..... 354/303; 354/314; 354/317; 354/318

[58] Field of Search ..... 354/83, 84, 78, 301, 354/303, 304, 305, 313, 314, 317, 318, 275, 198; 352/78 R, 130

[56] References Cited

U.S. PATENT DOCUMENTS

| | | | |
|---|---|---|---|
| 2,848,931 | 8/1958 | Troidl | 354/318 |
| 2,880,657 | 4/1959 | Bartlett | 354/78 R |
| 3,711,192 | 1/1973 | Land | 352/78 R |
| 4,167,318 | 9/1979 | Wareham | 354/298 |
| 4,212,521 | 7/1980 | Stella | 352/130 |
| 4,212,527 | 7/1980 | Fischer | 354/275 |

OTHER PUBLICATIONS

Research Disclosure, pp. 132–134, Apr. 1980.

*Primary Examiner*—L. T. Hix
*Assistant Examiner*—Alan Mathews
*Attorney, Agent, or Firm*—Alfred E. Corrigan

[57] ABSTRACT

Apparatus for processing an exposed roll of instant or self-developing type transparency film. The apparatus includes structure for supporting a film cassette containing an exposed roll of film, a spool having an elongate strip of sheet material wound thereupon, and a take-up reel which is adapted to receive an end of the exposed film and the sheet material and which is adapted to be rotated so as to wind the exposed film and the sheet material thereupon in superposed relation as a processing composition is being coated upon the sheet material so as to initiate the formation of visible images in the film. The apparatus also includes means for separating the film which is to be wound upon the take-up reel from its attachment to the film cassette's spool prior to stripping the sheet material from the film while simultaneously guiding the latter to the exterior of the apparatus.

5 Claims, 5 Drawing Figures

FILM PROCESSOR FOR INSTANT TYPE TRANSPARENCY FILM

RELATED APPLICATION

This application is related to Application Ser. No. 207,362, entitled Film Processor Having Automatically Actuated Film Severing Means, filed on even date herewith by Nicholas Gold.

BACKGROUND OF THE INVENTION

1. Field of the Invention

This invention relates to apparatus for receiving a film cassette containing therein a roll of exposed 35 mm instant film preparatory to processing the exposed film in the apparatus.

2. Description of the Prior Art

The present invention relates to apparatus for processing an exposed roll of film and, more particularly, to apparatus for processing an exposed roll of 35 mm self-developing or instant type transparency film.

One such type of apparatus is described in U.S. Pat. No. 2,880,657 wherein a camera-projector is provided with means for processing an exposed photosensitive sheet by superposing the photosensitive sheet with a second sheet and spreading a thin layer of processing composition between the superposed sheets as they are being wound upon a rotating drum. The photosensitive and second sheets are maintained upon the drum in superposition with the layer of processing composition interposed therebetween for a predetermined processing period during which visible images are produced in one of the sheets, preferably in the second sheet. At the end of this predetermined period of time, the second sheet is stripped from the photosensitive sheet, advanced past a projector such that the images therein may be viewed, and then wound upon a take-up spool. However, this apparatus does not lend itself to the processing of 35 mm instant type film, which film is packed in a cylindrically shaped 35 mm type film cassette which is adapted to be exposed outside the processing apparatus, i.e., in conventional 35 mm cameras.

Lately, interest has been expressed in providing a film assemblage wherein a roll of 35 mm instant type film is housed within a film cassette having a configuration whereby it is readily adapted to be mounted within conventional 35 mm cameras, e.g., a Minox 35 EL, manufactured by Minox GmbH of Lahnstadt 1, West Germany. As such, these film assemblages release the conventional 35 mm camera from their time long restraint, i.e., use with conventional film only. Examples of these film assemblages may be found in U.S. Pat. Nos. 4,212,527 and 4,167,318 and in pages 132–134 of Research Disclosure dated April, 1980.

The film assemblages disclosed in the RESEARCH DISCLOSURE article basically include a cylindrically shaped film cassette of the type adapted to be received within conventional 35 mm cameras, a supply of film, and processing composition located within the film cassette. The film in these assemblages is adapted to be processed in the camera in which the film was exposed. After the film has been almost totally withdrawn from the film cassette during the exposure thereof, it is rewound into the film cassette and during such rewinding, a container (or a plurality of containers) of the processing composition is ruptured by a lip located adjacent to the film withdrawal slot in the cassette and its contents spread between superposed sheets of the film. Disadvantages with these types of film assemblages are many and include (1) a limit on the length of film that may be wound within the film cassette due to the volume occupied by the processing composition, and (2) the shelf life of the assemblage is a function of the shelf life of the film or that of the processing liquid, whichever is the shorter, vis-a-vis an assemblage which does not contain the processing composition as a part thereof.

Each of the film assemblages disclosed in the aforementioned U.S. Pat. Nos. 4,212,527 and 4,167,318 is adapted to be placed in apparatus for processing the exposed film. The apparatus described in U.S. Pat. No. 4,212,527 includes an extendible dark chamber for receiving the exposed film after it has been treated with a processing composition, thereby adding to its cost and overall size. The apparatus described in U.S. Pat. No. 4,167,318 is rather large in comparison to the size of the film cassette used therein; and its operation includes the complete removal of the exposed film from the film cassette before it can be processed, a step which adds to the cost of the apparatus due to the control circuit which must be built into the apparatus to detect the presence of the trailing end of the exposed film and its associated container of processing composition.

From the above, it can be seen that there is a need for a small compact apparatus for processing a roll of exposed 35 mm instant type film. The apparatus should include means for housing and thereafter superposing a second sheet with the exposed sheet of film so as to facilitate the formation of visible images in one of the two sheets, preferably in the sheet of film, thereby enabling a greater length of film to be originally coiled within the film cassette. Further, the apparatus should be provided with means for stripping the film from the second sheet while the former is being simultaneously guided to the exterior of the apparatus.

SUMMARY OF THE INVENTION

The instant invention relates to apparatus for processing a photographic film assemblage of the type including a film cassette containing therein a roll of 35 mm instant or self-developing type transparency film. The film cassette is preferably cylindrically configured and is adapted to be readily received by conventional 35 mm still type cameras. The apparatus includes a lighttight housing having an exit opening in one wall thereof through which an exposed and processed sheet of film is adapted to be advanced to the exterior of the apparatus. Mounted within the lighttight housing are a film cassette support, a spool containing a supply of a sheet material, e.g., a polyester film such as Mylar, and a take-up reel mounted between the film cassette support and the spool. A free end of the sheet material is adapted to be guided around an idler roller, directed beneath a coater which is adapted to apply a layer of processing composition to one side of the sheet as it passes therebeneath, and finally the free end is secured to the take-up reel. A film cassette of the type described is adapted to be located on the film cassette support such that the protruding end of the exposed film may be guided between the anvil and knife of a film cutter, over a second idler roller and then secured to the take-up reel. The take-up reel is adapted to be driven, either manually or by a motor in a direction which superposes the emulsion side of the exposed film with the side of the sheet material having the coating of processing composition thereon. After the last frame of the film has passed the film cutter, the latter is actuated so as to separate the film to be superposed with the sheet material from the spool of the film cassette. The film and sheet material are permitted to stay wound upon the take-up reel in the aforementioned superposed relation for a predetermined period of time. This period of time is approximately equal to that necessary to complete the processing of the film to a point where it may now be sent to the exterior of the processor without being adversely affected by being subjected to the ambient light. The spool from which the sheet material was withdrawn is then driven in a direction to rewind the sheet material thereupon. During this rewinding of the sheet material, the superposed film and sheet material are advanced beneath the coater (which has been previously raised to a non-coating position) and toward a film stripper which strips the film from the sheet material and guides it toward the exit opening while the sheet material is being redirected toward and rewound upon the spool. The spool and sheet material may then be replaced with a new supply in preparation for the processing of another roll of exposed film.

An object of the invention is to provide apparatus for supporting an exposed strip of film and a spreader sheet in superposition with a layer of processing composition interposed therebetween and, after a predetermined period of time, stripping the film from the spreader sheet while simultaneously directing it to the exterior of the apparatus.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
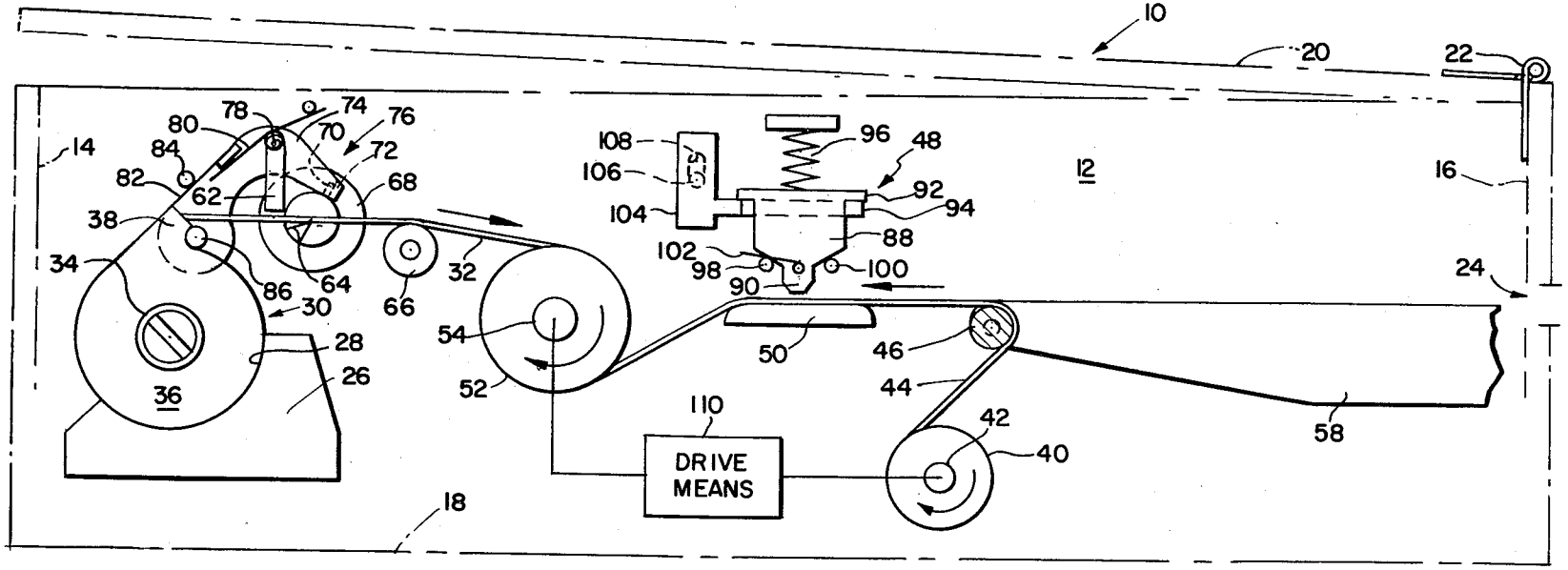
FIG. 1 is an elevational view, partly in cross section, of the processor of the instant invention, wherein a strip of exposed film is being withdrawn from a film cassette and superposed upon a take-up reel with a sheet material which has been previously coated with a processing liquid.
Figure 2:
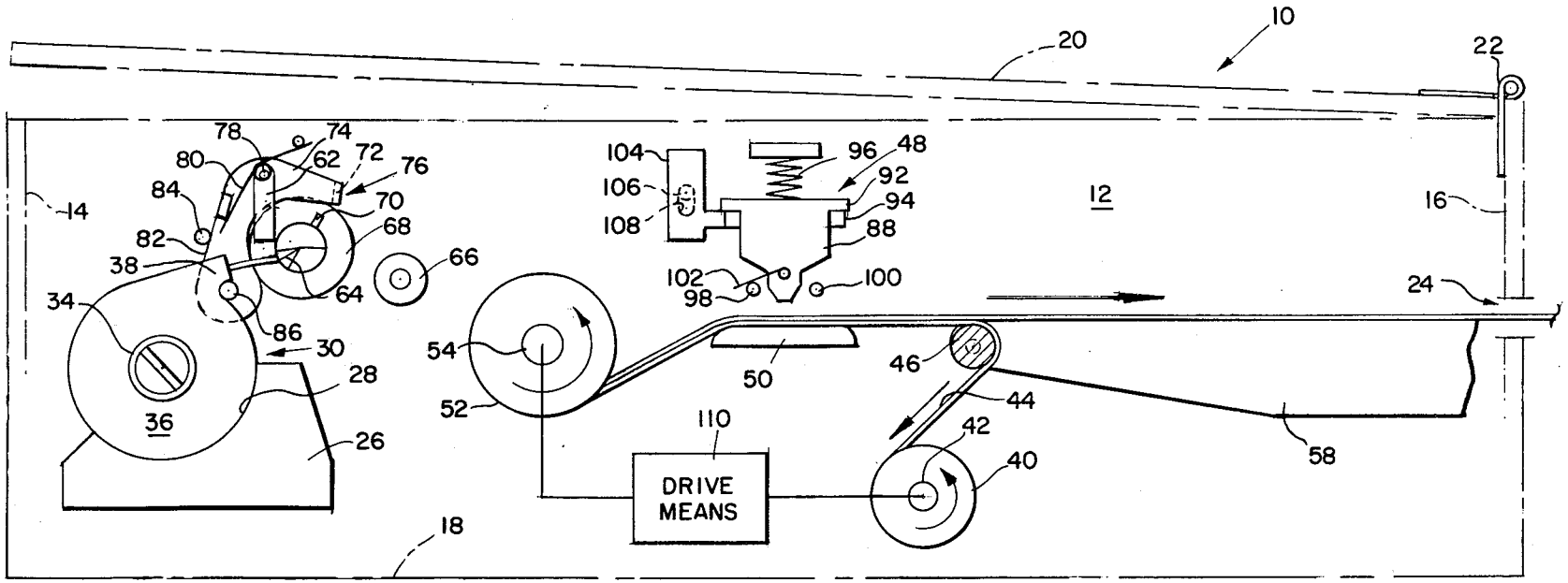
FIG. 2 is a view similar to FIG. 1 showing the position and operation of various elements of the processor after the film being wound upon the take-up reel has been separated from its attachment with a film spool located within the film cassette.

Reference is now made to FIGS. 1 and 2 of the drawings wherein is shown apparatus 10 for processing a roll of exposed self-developing or instant transparency film, preferably of the 35 mm type. The processing apparatus 10 includes a lighttight housing having a pair of side walls 12 (only one being shown), a pair of end walls 14 and 16, a bottom wall 18 and a top wall 20 which is pivotally coupled to the end wall 16 by a hinge 22 and which serves as a loading door for the apparatus 10. An exit slot 24 (having suitable means for preventing the passage of light therethrough) is formed in the end wall 16 so as to permit the passage of a processed strip of film to the exterior of the apparatus 10.

A block 26 having an arcuate portion 28 is suitably fixedly secured within the apparatus 10. The block 26 is adapted to support a film cassette 30 containing a roll of exposed, self-developing or instant type transparency film 32. The film cassette 30 preferably has a generally cylindrical configuration which conforms to the arcuate portion 28 and is adapted to be received in conventional 35 mm cameras of the type presently available on the market. As is well known in the art, the elongate strip of film 32 is wound upon a spool, an end portion of which is shown at 34 protruding through an end cap 36 of the film cassette 30. One end of the film 32 is fixedly secured to the spool while the opposite end of the film 32 extends to the exterior of the film cassette 30 via an exit slot located in a protruding portion 38 of the film cassette 30.

Also mounted within the apparatus 10 is a spool 40, the journals 42 (only one being shown) of which are suitably supported for rotation by the side walls 12. A supply of sheet material 44, preferably a polyester film such as Mylar, is wound upon the spool 40. One end of the sheet material 44 is secured to the shaft of the spool 40, and the opposite end of the sheet material 44 is guided around an idler roller 46, between a processing composition applicator 48 and a support plate 50 and then to a withdrawing means in the form of a take-up reel 52 where it is releasably secured within a radially extending slot. The take-up reel 52 includes a journal 54 (only one shown) at each end thereof, which journals are rotatably supported within or by the side walls 12 of the apparatus. Also, the journals 56 of the idler roller 46 are rotatably supported by the ends of a pair of cantilevered supported arms 58 and 60 which extend inwardly from the end wall 16.

As best seen in FIG. 1, the film 32 extends from the film cassette 30, between an anvil 62 and a rotary knife 64, across an idler roller 66, and then to the take-up reel 52 where its free end (heretofore referred to as the opposite end) is suitable releasably secured within the aforementioned radially extending slot in the take-up reel 52.

The rotary knife 64 is adapted to be driven by a spring loaded one revolution clutch 68. The clutch 68 is mounted for clockwise rotation and includes an inwardly extending stop lug 70 which is adapted to be engaged by a flange 72 which extends at a right angle to an arm 74 of a bell crank 76 for maintaining the clutch in the position shown in FIG. 1. The bell crank 76 is pivotally mounted about a pin 78 and is biased in a clockwise direction by a spring 80 such that its other arm 82 is normally located in engagement with a stop pin 84. At this point, it should be noted that the anvil 62 is fixedly mounted on the pin 78. Still another pin 86 extends inwardly from the arm 82 such that it is located directly below and in engagement with the protruding portion 38 of the film cassette 30.

The processing composition applicator 48 includes a tank 88 for containing a supply of the processing composition, a nozzle 90 at its bottom end, and an enlarged peripheral portion 92 which is adapted to be supportively received by an annular arm 94 having an inside diameter less than the diameter of the peripheral portion 92. The nozzle 90 has a longitudinal dimension substantially equal to the width of the sheet material 44. The tank 88 is adapted to be biased into the position shown in FIG. 1, i.e., a coating position, by a spring 96 such that the bottom of the tank 88 is located in engagement with a pair of stop pins 98 and 100, and the pin 98 is holding a valve 102 in an open position thereby permitting the flow of the processing composition through the nozzle 90. The annular arm 94 extends from a generally rectangularly shaped member 104 which is mounted for movement in a vertical direction by means not shown. A handle 106 extends from the member 104 to the exterior of the apparatus 10 via a vertical slot 108 located in the side wall 12. The handle 106 may be grasped by the operator and moved upwardly thereby moving the applicator 48 to a non-coating position in which the valve 102, under its spring bias in a counterclockwise direction, will move to the position shown in FIG. 2, thereby stopping the flow of the processing composition to the nozzle. Suitable latch means may be provided for releasably retaining the handle in the up position. From an inspection of FIGS. 1 and 2, it can be seen that the dimensions of the member 104 relative to the slot 108 are such that it functions to prohibit the passage of light through the slot 108 regardless of the position of the member 104.

Figure 3:
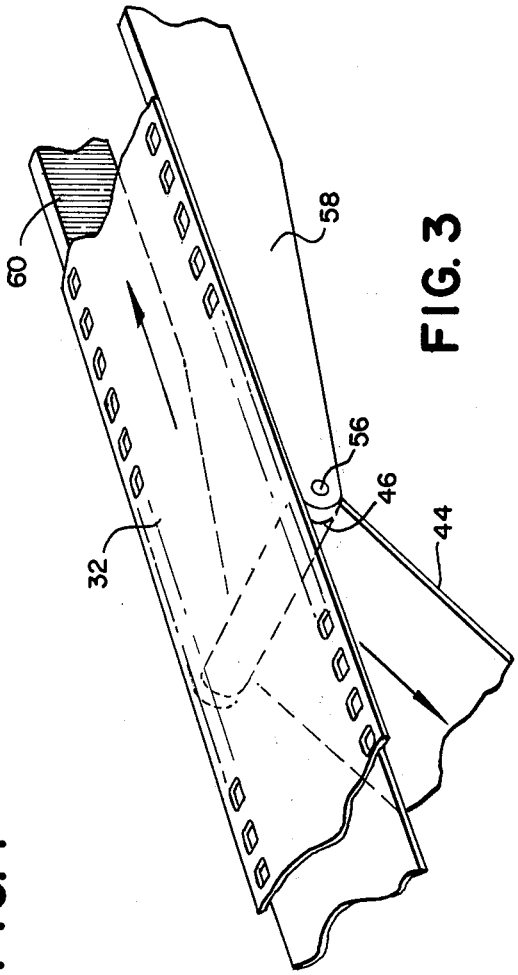
FIG. 3 is a perspective view of a portion of a film stripping apparatus.

In the operation of the apparatus 10, the loading door or top wall 20 is rotated about the hinge 22 to a loading position wherein a film cassette 30 containing a roll of exposed film 32 may be placed upon the block 26 such that its protruding portion 38 is located adjacent the pin 86, and the end of the film 32 is attached to the take-up reel 52 by being threaded between and across various elements of the apparatus, as previously described and as shown in FIG. 1. Also, a new spool 40 of sheet material is loaded into the apparatus 10 and the free end of the sheet material 44 is attached to the take-up reel 52, as previously described. The loading door 20 is then closed and the applicator 48 is manually lowered into its coating position, as shown in FIG. 1. Suitable drive means 110 is then coupled to the take-up reel 52 so as to drive it in a clockwise direction while the spool 40 is allowed to rotate freely about its journals 42. Rotation of the take-up reel 52 is effective to wind the exposed film 32 in superposition with the sheet material 44 upon the take-up reel 52 while a coating of processing composition is being applied to one surface of the sheet material 44. When the film 32 is completely unwound from its spool 34, the amount of back tension in the length of film which runs from the take-up reel 52 to the film cassette 30 increases greatly due to the fact that the end of the film 32 is still attached to the spool 34 within the film cassette 30. This increase in tension is effective to rotate the film cassette 30 in a clockwise direction into the position shown in FIG. 2 thereby causing the protruding portion 38 of the film cassette 30 to engage and move the pin 86 and the bell crank 76 in a counterclockwise direction about the pin 78. This movement of the bell crank 76 removes the flange 72 from the lug 70 on the spring loaded one revolution clutch 68 thus permitting the rotary knife 64 to be driven by the clutch's spring through one revolution thereby severing the film 32. Once the film 32 has been severed, the spring 80 returns the bell crank 76 to the position shown in FIG. 1 wherein the flange 70 moves into the path of movement of the lug 68 to thereby halt rotation of the clutch 68. The spring of the clutch 68 may then be manually retensioned by suitable means which extends to the exterior of the apparatus 10. Alternatively, the end of the film may be detected by any other suitable means, and the film cutting knife may then be manually actuated to separate the film which is to be wound upon the take-up reel 52 from its attachment to the spool 34 within the film cassette 30. After the film 32 has been fully wound upon the take-up reel 52 in superposition with the coated spreader sheet or sheet material 44, the drive means 110 is stopped and the superposed film and sheet material 44 are permitted to stay upon the take-up reel 52 for a predetermined period of time. This predetermined period of time is preferably equal to that time necessary to complete the processing of the film, i.e., the film 32 has been processed to the point whereat it may be moved to the exterior of the apparatus 10 without the images in the film being adversely affected by the ambient light. At this point in the operation of the apparatus 10, the applicator is raised to the non-coating position shown in FIG. 2, and the drive means 110 is drivingly coupled to the spool 40 so as to rotate it in a counterclockwise direction while the take-up reel 52 is allowed to rotate freely about its journals 54. Counterclockwise rotation of the spool 40 is effective to rewind the spreader sheet 44 upon the spool 40 while simultaneously removing the superposed film 32 and the sheet material 44 from the take-up reel 52. As can best be seen in FIG. 3, as the superposed film 32 and sheet material 44 approach the idler roller 46, the sheet material 44 is redirected downwardly and to the left while the greater width of the film 32 relative to the sheet material 44 allows the lateral edges of the film 32 to ride along the upper surfaces of the arms 58 and 60 thereby resulting in the sheet material or spreader sheet 44 being stripped from the exposed film 32 while the latter is being advanced to the exterior of the apparatus 10 via the exit slot 24. Also, this greater width of the film 32 keeps its lateral edges free from contact with the processing composition.

Figure 4B:
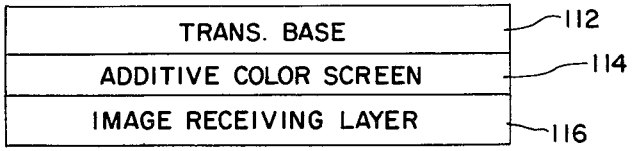
FIG. 4*b* is a view similar to FIG. 4*a* showing the strip of film after it has been stripped from the spreader sheet.
Figure 4A:
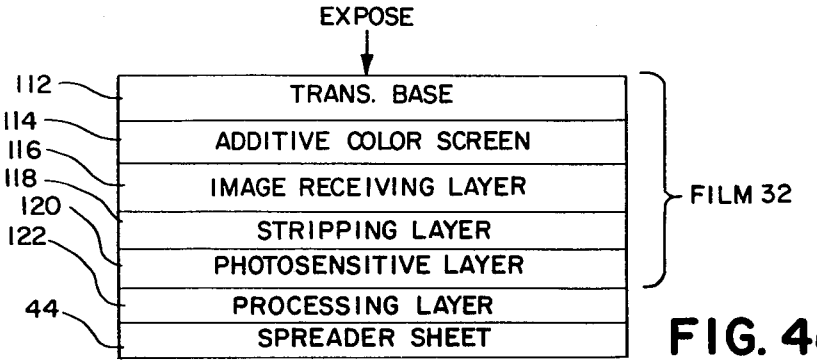
FIG. 4*a* is a diagrammatic enlarged cross-sectional view of a strip of film superposed with a spreader sheet and having a coating or layer of processing composition therebetween.

In a preferred embodiment of the invention, the film 32 basically takes the form shown in FIG. 4*a*. The film 32 includes a plurality of layers including, in sequence, a transparent base 112 through which an exposure is made, an additive color screen 114, an image receiving layer 116, a stripping layer 118, and a photosensitive layer 120. It will be noted from FIG. 1 that as the sheet material or spreader sheet 44 and the film 32 are brought into contact with each other at the take-up reel 52, it is the layer of the film unit 32 which is most distant from the transparent base 112 that is placed in intimate contact with the surface of the sheet material 44 having a layer of processing composition 122 coated thereon. Subsequent to processing, the photosensitive layer 120 exhibits a greater adhesion to the spreader sheet 44 than to the next adjacent layers whereby removal of the spreader sheet 44 serves to remove the photosensitive layer 120 thus increasing visual acuity and brightness of the resultant positive transparency, shown in FIG. 4*b*, and enhancing its stability by virtue of the removal of residual processing reagent in the photosensitive layer 120. In a particularly preferred embodiment, the stripping layer 118 is employed to facilitate removal of the photosensitive layer 120. For further details of the film, reference may be had to U.S. Pat. No. 3,682,637 granted to E. H. Land on Aug. 8, 1972. After the sheet material or spreader sheet 44 has been completely rewound upon the spool 40, it may be removed from the apparatus 10 and safely discarded. The developed strip of film 32 may then be completely removed from the apparatus 10 and the individual frames cut and mounted for subsequent viewing.

In an alternative embodiment, the visible images will be formed in the spreader sheet 44. Accordingly, the film 32 would be comprised of a photosensitive layer through which the exposure would be made and a base which may or may not be transparent. Also, the spreader sheet 44 would be comprised of a transparent base and an image receiving layer. Subsequent to the exposure of the film 32, the side of the spreader sheet 44 containing the image receiving layer would be coated with the processing composition 122 and brought into engagement or superposition with the side of the film through which the exposure had been made. After the spreader sheet had been rewound upon its spool, the spool would be removed and the individual scenes in the spreader sheet would be cut and mounted for subsequent viewing.

Since certain changes may be made in the above apparatus without departing from the scope of the invention herein involved, it is intended that all matter contained in the above description or shown in the accompanying drawings shall be interpreted as illustrative and not in a limiting sense. For example, while the take-up reel 52 and the spool 40 have been described as being alternatively driven by a drive means 110, it is within the scope of the invention to use other suitable drive means, e.g., a crank.

What is claimed is:

1. Apparatus for receiving a film cassette containing a roll of exposed, self-developing type transparency film preparatory to processing the film, the roll of film being wound upon a spool and having one end thereof secured to the spool and an opposite end extending to the exterior of the film cassette via a film withdrawal slot, said apparatus comprising:

a housing defining a lighttight enclosure in which photographically exposed film is adapted to be processed, said housing including means defining an opening through which the film is adapted to be moved subsequent to processing, and means defining a loading door providing access to the interior of said housing;

first means for supporting a film cassette containing a roll of exposed, self-developing type transparency film;

second means for supporting a supply of sheet material;

means for withdrawing the sheet material and the exposed film from said second supporting means and the film cassette and orienting them in superposition;

first drive means for driving said withdrawing means in a direction so as to superpose the sheet material and the exposed film upon said withdrawing means;

means for applying a coating of processing composition to one side of either the sheet material or the film prior to said superpositioning, the processing composition being adapted to initiate the formation of visible images in either the film or the sheet material;

means for separating the film from its attachment to the spool within the cassette;

second drive means operative to drive said second support means in a direction to remove the superposed sheet material and film from said withdrawing means; and means for stripping the film from the sheet material and guiding the film through said opening.

2. Apparatus as defined in claim 1 wherein said withdrawing means comprises a rotatable reel which is adapted to receive the opposite end of the film and an end of the sheet material prior to winding the film and sheet material upon said reel in superposition with each other.

3. Apparatus as defined in claim 2 wherein said second supporting means comprises a spool rotatably supported within said housing.

4. Apparatus as defined in claim 3 wherein said applying means applies a coating of processing composition to the sheet material prior to it being superposed with the film upon said reel.

5. Apparatus as defined in claim 1 wherein the visible images appear in the film.

* * * * *